United States Patent [19]

Mc Vey

[11] 4,186,366

[45] Jan. 29, 1980

[54] RADIAL LEAD THERMAL CUT-OFF DEVICE

[75] Inventor: John K. Mc Vey, Bensenville, Ill.

[73] Assignee: Illinois Tool Works Inc., Chicago, Ill.

[21] Appl. No.: 953,305

[22] Filed: Oct. 20, 1978

[51] Int. Cl.[2] ..... H01H 37/76

[52] U.S. Cl. ..... 337/407; 337/408

[58] Field of Search ..... 337/407, 408, 409

[56] References Cited

U.S. PATENT DOCUMENTS

| | | | |
|---|---|---|---|
| 2,955,179 | 10/1960 | Milton et al. | 337/408 X |
| 3,956,725 | 5/1976 | Merrill et al. | 337/409 |
| 4,065,741 | 12/1977 | Sakamoto et al. | 337/407 |

*Primary Examiner*—George Harris

*Attorney, Agent, or Firm*—Glenn W. Bowen; Robert W. Beart

[57] ABSTRACT

A radial lead thermal cut-off device for opening an electrical circuit when a predetermined temperature is disclosed. Electrical connection between the radial leads is maintained by thin spring contact which is forced against the terminal heads of the leads of the device. The spring contact is forced into contact by a disc against the force of a coiled bias spring that engages the center of the spring contact. The disc is held in place by a temperature-sensing pellet of organic material which melts at a predetermined temperature and which preferably incorporates a multitude of spherical glass beads filling that greatly increase its strength. The pellet has a centrally located cavity so that when the organic material of the pellet melts the material fills a volume having a smaller transverse dimension. This allows the disc to move as the compression force of the coiled spring is relieved, which in turn opens the circuit between the contact members as the thin spring contact is forced away from the lead heads by the coiled spring.

4 Claims, 3 Drawing Figures

Fig. 1
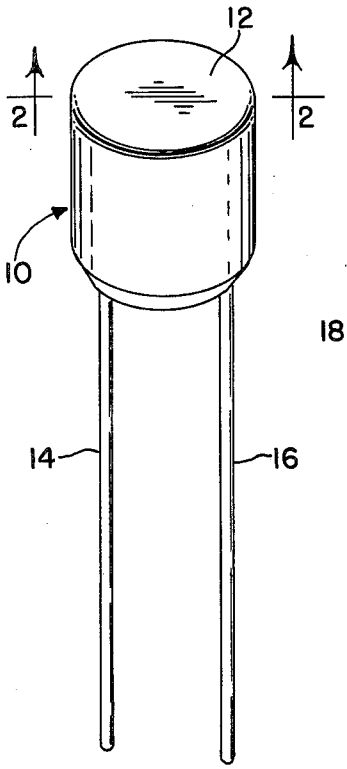
Fig. 2
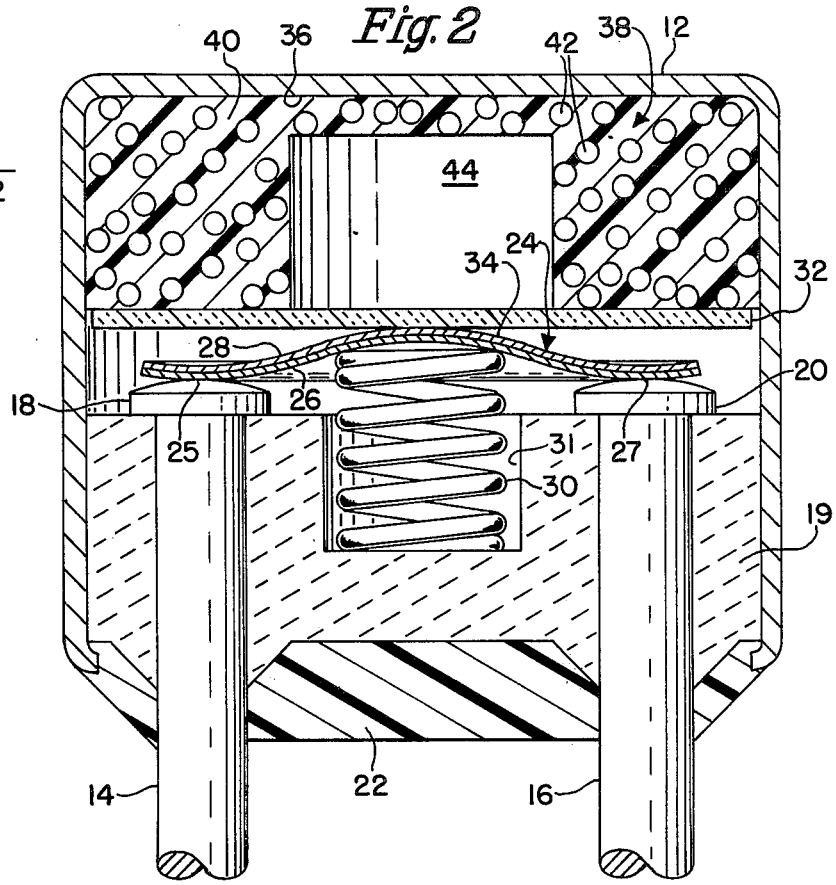
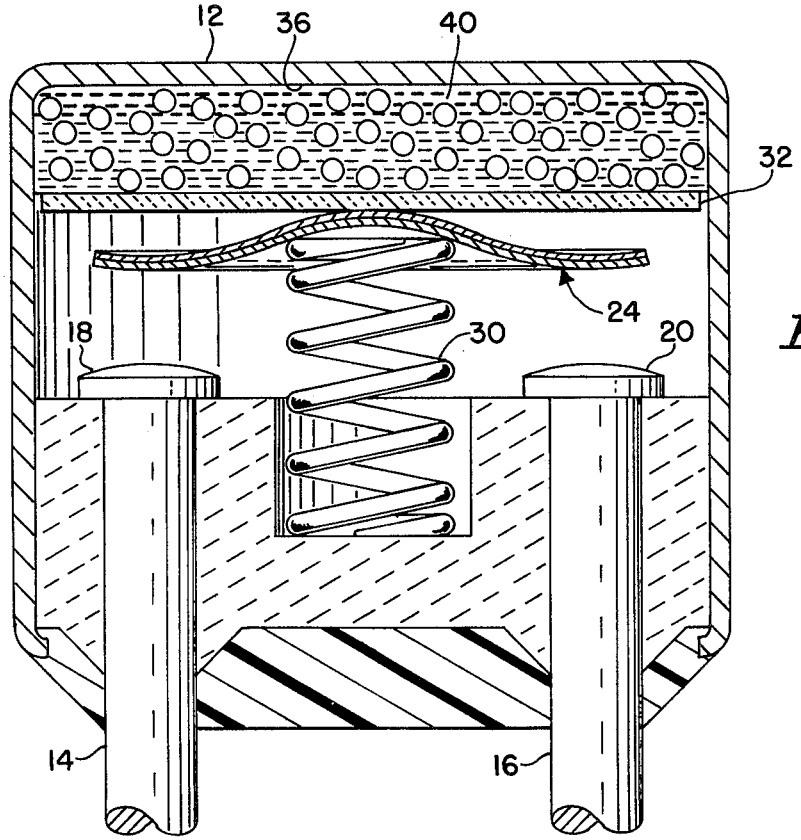
Fig. 3

RADIAL LEAD THERMAL CUT-OFF DEVICE

BACKGROUND OF THE INVENTION

Axial-lead thermal cut-off devices presently predominate over radial-lead devices. This results, at least in part, from design difficulties that exist in manufacturing a reliable, inexpensive radial-lead thermal cut-off device. However, in many circuit applications radial-lead devices are preferable since they take up a smaller area on a printed circuit board. The design of the present invention provides a simple, reliable, radial-lead thermal cut-off which thereby enables thermal cut-off evices to be incorporated into applications where size of the device is of crucial importance.

DESCRIPTION OF THE DRAWING

The present invention is illustrated by reference to the drawings in which:

FIG. 1 is an overall perspective view of the thermal cut-off device of the present invention;

FIG. 2 is a cross-sectional view of the thermal cut-off device of FIG. 1 showing the device before the predetermined sensing temperature has been reached; and FIG. 3 is a cross-sectional view of the device of FIG. 1 taken along the lines 2—2 showing the device after the predetermined sensing temperature has been reached.

TECHNICAL DESCRIPTION OF THE INVENTION

The thermal cut-off device 10 of the present invention that is shown in FIG. 1, has an outer housing 12 which may be of either a conductive material or an electrically insulating material. A pair of radial leads 14, 16 extend out of the bottom of the housing 12. A cross-sectional view of the thermal device of FIG. 1 taken along the lines 2—2 is shown in FIG. 2. The radial leads 14, 16 have enlarged terminal heads 18, 20 that extend into the housing 12. The leads 14, 16 are supported in place by a ceramic insulator 19, through which the leads 14, 16 pass. The bottom of the housing is sealed by appropriate sealing means to prevent the accumulation of moisture in the housing, such as epoxy or silicone, for example.

Electrical connection between the leads 14, 16 is provided by a thin spring contact 24 which is held in the arcuate position shown in FIG. 2 when the device is assembled. The spring contact 24 is preferably a bimetallic member which consists of a metal having good spring properties, such as stainless steel, and a metal having good conductive properties, such as copper. The copper is employed to supply the current carrying capacity for the device where the stainless steel provides good spring characteristics at elevated temperatures. A coiled bias spring 30 is under compression and engages the center of the spring contact 24 thereby forcing the center of the spring contact 24 up away from the lead heads 18, 20. The resulting arcuate shape of the spring member 24 and the positioning of the copper layer 26 on the bottom and the stainless steel layer 28 on the top thus maintains contact pressure on the terminal heads 18, 20 to prevent premature opening of the circuit before the predetermined temperature to be sensed is reached.

A disc 32, which may be made of either an insulating material or a metal, engages the upper surface of central area 34 of the spring contact 24 to apply a force on this area. A temperature-sensing pellet 38 is positioned between the disc 32 and the upper wall of the housing 36. While the pellet 38 may be comprised entirely of an organic material that melts at the predetermined temperature to be sensed, it is preferred that it be comprised of a mixture of an organic material and of a multitude of spherical glass beads, in which the volume of the insulating beads preferably substantially exceeds the volume of the temperature-sensing material. Manufacture of the thermal sensing pellet in this manner eliminates the voids which occur in the pressed organic pellets that are conventionally used in temperature-sensing devices. The elimination of these voids greatly increases the strength of the otherwise relatively fragile pellet, thereby improving the reliability of thermal cut-off devices. The structure of the organic mixture-insulating particle pellet to the present invention is described in more detail in Ser. No. 940,418 filed Sept. 7, 1978 entitled "Thermal Switch With Organic-Glass Bead Mixture Sensing Pellet" filed in the name of John McVey, Bruce Luxon, and Larry Sharp and assigned to the assignee of the present invention, and this application is hereby incorporated by references to the present application. While spherical glass beads are preferred in organic pellet insulating particle mixture, different shapes and materials may be used. The insulating particles, however, should have a substantially higher melting temperature than the melting temperature of the organic material.

The spring contact 24 preferably has a silver plated outer surface layer in order to reduce contact resistance. A nickle flash is also preferably plated over the spring contact 24 prior to the silver plating in order to prevent migration of the silver into the copper layer at elevated temperatures.

The term "insulating", as used herein in describing the properties of various components of the described thermal switch, refers to the property of electrical insulation. Thus, while glass beads are good electrical insulators, they are also relatively good conductors of heat, and this is an advantage in the manufacture of the pellet and this is an advantage in the manufacture of the pellet 38 since the organic material may be placed above the multitude of insulating particles and allowed to flow down over them by gravity, as described in the previously mentioned McVey et al application.

FIG. 3 shows the thermal cut-off device of the present invention after the predetermined temperature of the melting point of the organic material 40 has been reached. As shown in FIG. 2, the pellet 38 has a cylindrically-shaped cavity 44 which extends part way through the pellet. When the organic material melts the glass beads 42 redistribute themselves as indicated in FIG. 3, in which the thermal sensing organic material 40 is in a liquid state. When this occurs the disc 32 moves upwardly due to the reduced transverse dimension of the volume occupied by the organic material between the disc 32 and the upper surface 36 of the housing 12. The arcuate-shaped spring contact 24 then moves upwardly, thereby breaking contact with the heads 18, 20 of the leads 14, 16 due to the release of the compressive force of the coiled spring 30.

What is claimed is:

1. A thermal cut-off device comprising a housing, a pair of radial leads each having a thermal head which extends into said housing, a relatively thin spring contact which has its outer ends in contact with the thermal ends of the leads and a center portion, a coiled bias spring engaging said center portion of said spring contact to bias it away from said leads, a force-applying member in contact with said center portion of said spring contact and a temperature-sensing pellet comprising a temperature sensing material which melts at a predetermined temperature to be sensed, said pellet being positioned between said housing and said force-applying member, said pellet having a shape such that all of the space between said force-applying member and said housing is not occupied by said pellet, so that when said temperature-sensing material melts, said bias means will force said spring contact away from said heads of said leads thereby breaking the electrical connection therebetween.

2. A thermal cut-off device as claimed in claim 1 wherein said spring contact is a bimetallic member comprised of a metal having good spring properties and a metal having good electrical conductive properties, and said spring layer and said conductive layer are positioned such that the contact pressure of said heads of said leads by said spring member is maintained as the ambient temperature increases toward the predetermined temperature to be sensed.

3. A thermal cut-off device as claimed in claim 1 wherein said center portion of said spring contact is bowed away from said heads to form an arcuately shaped contact member.

4. A thermal cut-off device as claimed in claim 3 wherein said spring contact is a bimetallic member comprised of a metal having good spring properties and a metal having good electrical conductive properties, and said spring layer and said conductive layer are positioned such that the contact pressure of said heads of said leads by said spring member is maintained as the ambient temperature increases toward the predetermined temperature to be sensed.

* * * * *

UNITED STATES PATENT AND TRADEMARK OFFICE

CERTIFICATE OF CORRECTION

PATENT NO. : 4,186,366

DATED : January 29, 1980

INVENTOR(S) : John K. McVey

It is certified that error appears in the above-identified patent and that said Letters Patent are hereby corrected as shown below:

IN THE SPECIFICATION:

Column 1, line 14, "evices" should read "devices".
Column 2, line 32, "nickle" should read "nickel".
Column 2, line 42, delete repeated line 42.

IN THE CLAIMS:

Column 2, line 65, "thermal" should read --terminal--.
Column 2, line 68, "thermal" should read --terminal--.
Column 2, line 68, "ends" should read --heads--.
Column 4, line 1, the first occurrence of the word "of" should read --on--.
Column 4, line 15, the first occurrence of the word "of"

Signed and Sealed this

*Tenth* Day of *June 1980*

[SEAL]

*Attest:*

SIDNEY A. DIAMOND

*Attesting Officer*

*Commissioner of Patents and Trademarks*